US009453690B2

(12) United States Patent
Martin et al.

(10) Patent No.: US 9,453,690 B2
(45) Date of Patent: Sep. 27, 2016

(54) STACKED-PLATE HEAT EXCHANGER WITH SINGLE PLATE DESIGN

(71) Applicant: Dana Canada Corporation, Oakville (CA)

(72) Inventors: Michael A. Martin, Hamilton (CA); Ihab Edward Gerges, Oakville (CA); Nicole DeVeyra, Fergus (CA); Colin Arthur Shore, Hamilton (CA)

(73) Assignee: Dana Canada Corporation, Oakville, Ontario (CA)

( * ) Notice: Subject to any disclaimer, the term of this patent is extended or adjusted under 35 U.S.C. 154(b) by 466 days.

(21) Appl. No.: 14/064,417

(22) Filed: Oct. 28, 2013

(65) Prior Publication Data

US 2014/0116672 A1 May 1, 2014

Related U.S. Application Data

(60) Provisional application No. 61/720,465, filed on Oct. 31, 2012.

(51) Int. Cl.

| | |
|---|---|
| ***F28D 1/03*** | (2006.01) |
| ***F28F 3/04*** | (2006.01) |
| ***F28F 9/26*** | (2006.01) |
| ***F28F 13/12*** | (2006.01) |

(52) U.S. Cl.

CPC ..... *F28F 3/044* (2013.01); *F28D 1/0333* (2013.01); *F28F 9/26* (2013.01); *F28F 13/12* (2013.01); *F28D 1/035* (2013.01)

(58) Field of Classification Search

CPC .. F28D 1/0316; F28D 1/0325; F28D 1/0333; F28D 1/0341; F28D 1/035

USPC ..... 165/148, 153, 167, 170

See application file for complete search history.

(56) References Cited

U.S. PATENT DOCUMENTS

| | | | | |
|---|---|---|---|---|
| 1,990,752 | A | 2/1935 | Ragsdale | |
| 2,469,028 | A | 5/1949 | Belaieff | |
| 4,011,905 | A * | 3/1977 | Millard | F28D 1/0333 165/148 |
| 4,274,482 | A * | 6/1981 | Sonoda | B60H 1/3227 165/153 |
| 4,600,053 | A * | 7/1986 | Patel | F28D 1/0333 165/153 |
| 4,679,410 | A * | 7/1987 | Drayer | B60H 1/00335 165/153 |
| 4,712,612 | A | 12/1987 | Okamoto et al. | |
| 5,154,225 | A | 10/1992 | Armbruster et al. | |
| 5,182,856 | A | 2/1993 | Armbruster | |

(Continued)

FOREIGN PATENT DOCUMENTS

| | | |
|---|---|---|
| CA | 2485987 A1 | 12/2003 |
| JP | 405203385 | 8/1993 |
| JP | 406229691 | 8/1994 |

*Primary Examiner* — Leonard R Leo

(74) *Attorney, Agent, or Firm* — Marshall & Melhorn, LLC

(57) ABSTRACT

A plate-type heat exchanger comprising a plurality of spaced-apart stacked plate pairs, the plate pairs each comprised of first and second plates. The first and second plates each having an elongated central, planar portion surrounded by peripheral edge portions, the peripheral edge portions of the first and second plates being sealably joined together to form a first set of fluid passages in the heat exchanger. The first and second plates are provided with boss portions at respective ends of the plates, one of the boss portions being an elongated boss portion having a first position and a second position for the location of a fluid opening. The first and second heat exchanger plates are identical in structure and can be used to form various heat exchangers using the single plate design.

14 Claims, 7 Drawing Sheets

(56) References Cited

U.S. PATENT DOCUMENTS

| | | | | |
|---|---|---|---|---|
| 5,236,043 | A | 8/1993 | Armbruster et al. | |
| 5,553,664 | A * | 9/1996 | Nishishita | F28D 1/0341 165/153 |
| 5,896,916 | A | 4/1999 | Baechner et al. | |
| 5,950,589 | A | 9/1999 | Armbruster | |
| 5,954,126 | A | 9/1999 | Armbruster | |
| 6,082,449 | A * | 7/2000 | Yamaguchi | F28D 9/0075 165/153 |
| 6,247,528 | B1 | 6/2001 | Blomgren | |
| 6,543,528 | B2 | 4/2003 | Saito et al. | |
| 6,666,263 | B2 | 12/2003 | Luz et al. | |
| 6,889,758 | B2 | 5/2005 | Burgers et al. | |
| 6,938,686 | B2 | 9/2005 | Wu et al. | |
| 6,953,081 | B2 | 10/2005 | Klingler et al. | |
| 6,991,025 | B2 | 1/2006 | Beatenbough | |
| 7,044,205 | B2 | 5/2006 | Higashiyama | |
| 7,267,162 | B2 | 9/2007 | Bhatti et al. | |
| 7,588,072 | B2 | 9/2009 | Watanabe et al. | |
| 7,703,505 | B2 * | 4/2010 | So | F28D 1/0333 165/153 |
| 7,793,710 | B2 | 9/2010 | Lamich et al. | |
| 7,946,339 | B2 | 5/2011 | So et al. | |
| 8,122,943 | B2 | 2/2012 | Haller et al. | |
| 8,167,029 | B2 | 5/2012 | Bertilsson et al. | |
| 8,191,615 | B2 * | 6/2012 | So | F28D 1/0333 165/167 |
| 8,272,430 | B2 | 9/2012 | Yamada | |
| 2006/0231241 | A1 | 10/2006 | Papapanu et al. | |
| 2006/0266501 | A1 | 11/2006 | So et al. | |
| 2007/0029075 | A1 * | 2/2007 | Mehendale | F28D 1/0333 165/153 |
| 2008/0121381 | A1 | 5/2008 | So et al. | |
| 2009/0242182 | A1 | 10/2009 | Moreau | |
| 2010/0032148 | A1 | 2/2010 | Bermhult | |
| 2010/0258285 | A1 | 10/2010 | Yao et al. | |
| 2010/0282452 | A1 | 11/2010 | Diem et al. | |
| 2011/0168365 | A1 | 7/2011 | Garrett et al. | |
| 2011/0168366 | A1 | 7/2011 | Garrett et al. | |
| 2011/0180241 | A1 | 7/2011 | So et al. | |
| 2012/0247740 | A1 * | 10/2012 | Gertner | F28D 9/0006 165/148 |

* cited by examiner

STACKED-PLATE HEAT EXCHANGER WITH SINGLE PLATE DESIGN

CROSS-REFERENCE TO RELATED APPLICATION

This application claims priority to and the benefit of U.S. Provisional Patent Application No. 61/720,465, filed Oct. 31, 2012 under the title STACKED-PLATE HEAT EXCHANGER WITH SINGLE PLATE DESIGN. The content of the above patent application is hereby expressly incorporated by reference into the detailed description of the present application.

TECHNICAL FIELD

The invention relates to heat exchangers, in particular to stacked-plate heat exchangers.

BACKGROUND

Plate-type heat exchangers comprising a stack of spaced-apart plate pairs are known. Such heat exchangers are commonly employed for effecting heat transfer between a first fluid that pass through fluid channels formed by the plate pairs, and a second fluid that passes between the spaced-apart stacked plate pairs.

There is a continual need for improved heat exchangers of this type which are economical to manufacture and which provide for a degree of flexibility in design of the resulting heat exchanger to allow the heat exchanger to be customized for a particular use or customer requirement. Achieving a particular arrangement of fluid passes within a heat exchanger and accommodating various locations of headers/collectors or inlet/outlet manifolds (or fluid ports) often requires different heat exchanger plates to be manufactured in order to achieve a heat exchanger suited for a particular application. Whenever there is a change to the design, a new heat exchanger plate must be manufactured to accommodate the changes. Heat exchangers that require multiple plate designs to achieve desired flow patterns, fluid port locations and/or space/size requirements are costly given the number of different plate designs, corresponding dies, etc. that are required for manufacturing purposes. Given the ever-increasing pressure on space and/or size requirements and ever-changing customer requirements for size, shape, number of fluid passes, and fluid port locations for a particular heat exchanger, providing a heat exchanger with a single plate design that offers flexibility regarding the final, overall design of the heat exchanger combined with economical manufacturing costs is highly desirable.

SUMMARY OF THE PRESENT DISCLOSURE

In accordance with an example embodiment of the present disclosure there is provided a heat exchanger comprising a plurality of stacked plate pairs, each plate pair including first and second plates having elongate, central planar portions surrounded by peripheral edge portions, the peripheral edge portions of the first and second plates being sealably joined together; a first set of fluid passages defined between the elongate, central planar portions of said first and second plates; first and second boss portions formed at respective ends of each of said first and second plates and spacing apart one plate pair from an adjacent plate pair in said plurality of stacked plate pairs, the first and second boss portions defining respective inlet and outlet openings, the respective inlet and outlet openings of each of said first and second plates in said plurality of stacked plate pairs communicating to define respective inlet and outlet manifolds for the flow of a first fluid through said first set of fluid passages; one of said first and second boss portions being formed as an extended boss portion thereby defining a first position and a second position for the location of a flow opening, said flow opening being one of said inlet and outlet openings in one of said inlet and outlet manifolds; wherein the first and second positions in said extended boss portion are adjacent to each other along the length of the first and second plates, and wherein only one of said first and second positions is provided with said flow opening.

In accordance with another example embodiment of the present disclosure there is provided a heat exchanger plate for a stacked plate heat exchanger comprising an elongate, central planar portion; a peripheral edge portion surrounding the elongate, central planar portion; the peripheral edge portion extending from the central planar portion to an outer edge of the heat exchanger plate, the central planar portion and the peripheral edge portion being in different planes; first and second boss portions formed at respective ends of said heat exchanger plate, the first and second boss portions extending outwardly from and being raised out of the plane of the central planar portion; wherein one of said first and second boss portions is an elongated boss portion, the elongated boss portion having a first position and a second position for the location of a fluid opening, the first and second positions being in the same plane.

BRIEF DESCRIPTION OF THE DRAWINGS

Exemplary embodiments of the present disclosure will now be described, by way of example, with reference to the accompanying drawings, in which.

DETAILED DESCRIPTION OF EXEMPLARY EMBODIMENTS

Figure 1:
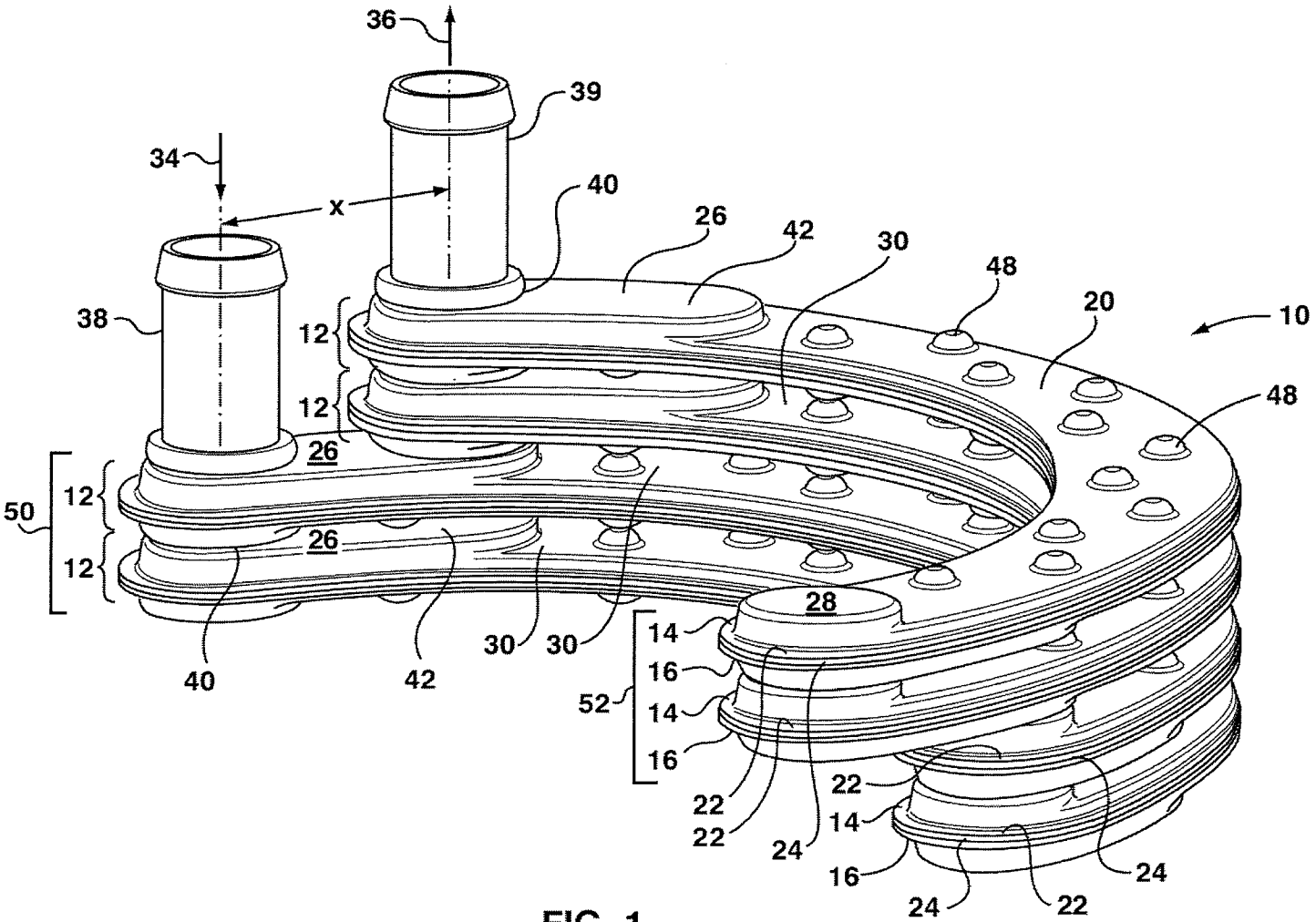
FIG. 1 is a perspective view of an exemplary embodiment of a heat exchanger of the present disclosure.

Referring now to FIG. 1, there is shown an exemplary embodiment of a heat exchanger 10 according to the present disclosure. Heat exchanger 10 is formed of a plurality of stacked plate pairs 12. Each plate pair 12 is comprised of a first plate 14 and a second plate 16 positioned in face-to-face stacking relationship. The first plate 14 and second plate 16 of each plate pair 12 are generally identical to each other in structure with the second plate 16 being positioned upside-down and, in some instances, rotated 180 degrees with respect to the first plate 14.

Figure 5:
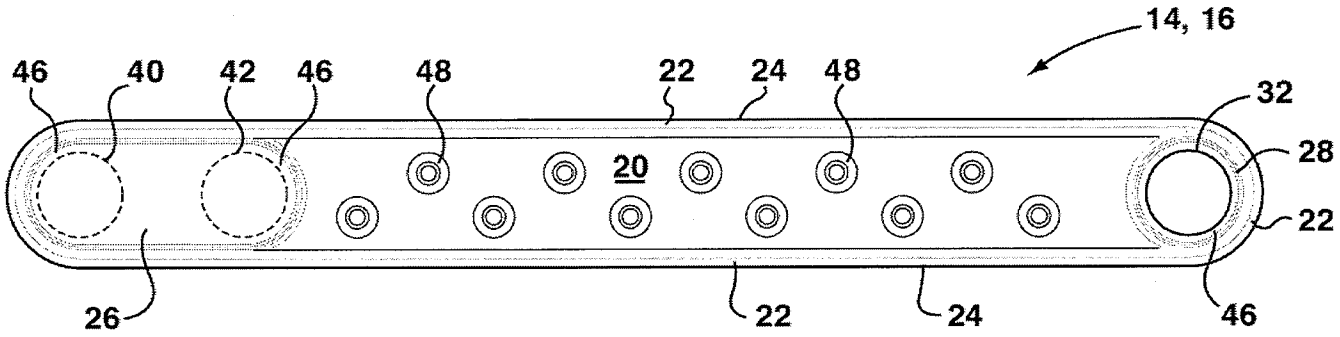
FIG. 5 is a top view of another exemplary embodiment of a heat exchanger plate according to the present disclosure.

First and second plates 14, 16 each have a central, elongate, generally planar portion 20 and a peripheral edge portion 22 that extends around the periphery of each of the plates 14, 16. The peripheral edge portion 22 extends away from the central, elongate, generally planar portion 20 to an outer edge 24 of the plate 14, 16. While heat exchanger 10 and first and second plates 14, 16 are shown in FIG. 1 as being arcuate in shape, it will be understood that the plates 14, 16 can also be formed as longitudinal, generally rectangular plates as shown in FIG. 5.

As shown in FIG. 1, the central, generally planar portion 20 of the first plate 14 is raised with respect to the peripheral edge portion 22, while the central, generally planar portion 20 of the second plate 16 is depressed or downwardly displaced with respect to the peripheral edge portion 22. Although, it will be understood that whether the central, generally planar portion 20 is raised or depressed with respect to the corresponding peripheral edge portion 22 depends primarily on the specific orientation of the heat exchanger 10.

The first and second plates 14, 16 are sealed together along their peripheral edge portions 22 when stacked in their face-to-face relationship thereby defining a first fluid passageway 18 between the spaced-apart central, generally planar portions 20 of the first and second plates 14, 16 of each of the plate pairs 12. Accordingly, the plurality of stacked plate pairs 12 defines a first set of fluid passages 18 within the heat exchanger 10.

Embossments or boss portions 26, 28 are formed at opposed ends of the first and second plates 14, 16. The boss portions 26, 28 extend out of the plane of the central, generally planar portion 20 such that when the plate pairs 12 are stacked together, the corresponding boss portions 26, 28 of adjacent plate pairs 12 align and mate with each other thereby spacing apart the adjacent plate pairs 12 to define a second set of fluid passages 30 therebetween. The boss portions 26, 28 are formed with respective inlet or outlet openings 32 in communication with the first fluid passageways 18 so that when the plate pairs 12 are stacked together, the inlet/outlet openings 32 in the boss portions 26, 28 of the stacked plate pairs 12 communicate to define respective inlet and outlet manifolds 34, 36 for directing the flow of a first fluid through the heat exchanger 10. In the example embodiment shown in FIGS. 1 and 4, the inlet and outlet manifolds 34, 36 are located adjacent to each other at one end of the heat exchanger 10, although other configurations are contemplated within the scope of the present disclosure as will be described in further detail below.

One of the boss portions 26, 28 of each of the first and second plates 14, 16 is formed as a "double" or elongated boss portion as compared to other of the boss portions 26, 28. In the example embodiment shown in FIG. 1, boss portion 26 is shown as the elongated boss portion while boss portion 28 is shown as the single boss portion. However, it will be understood that the opposite configuration where boss portion 28 is formed as the elongated boss portion is also contemplated within the scope of the present disclosure.

Figure 2:
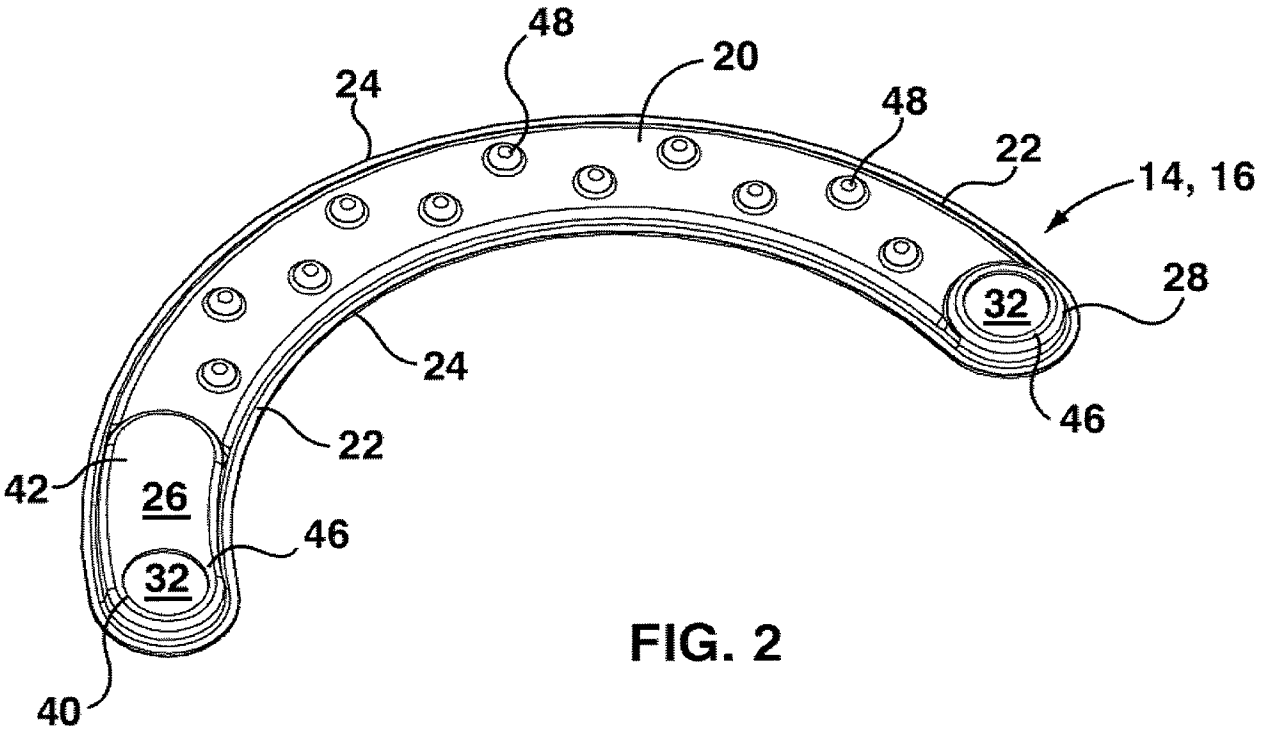
FIG. 2 is a top perspective view of a heat exchanger plate of the heat exchanger shown in FIG. 1 showing a first arrangement of inlet/outlet openings formed in the plate.
Figure 2A:
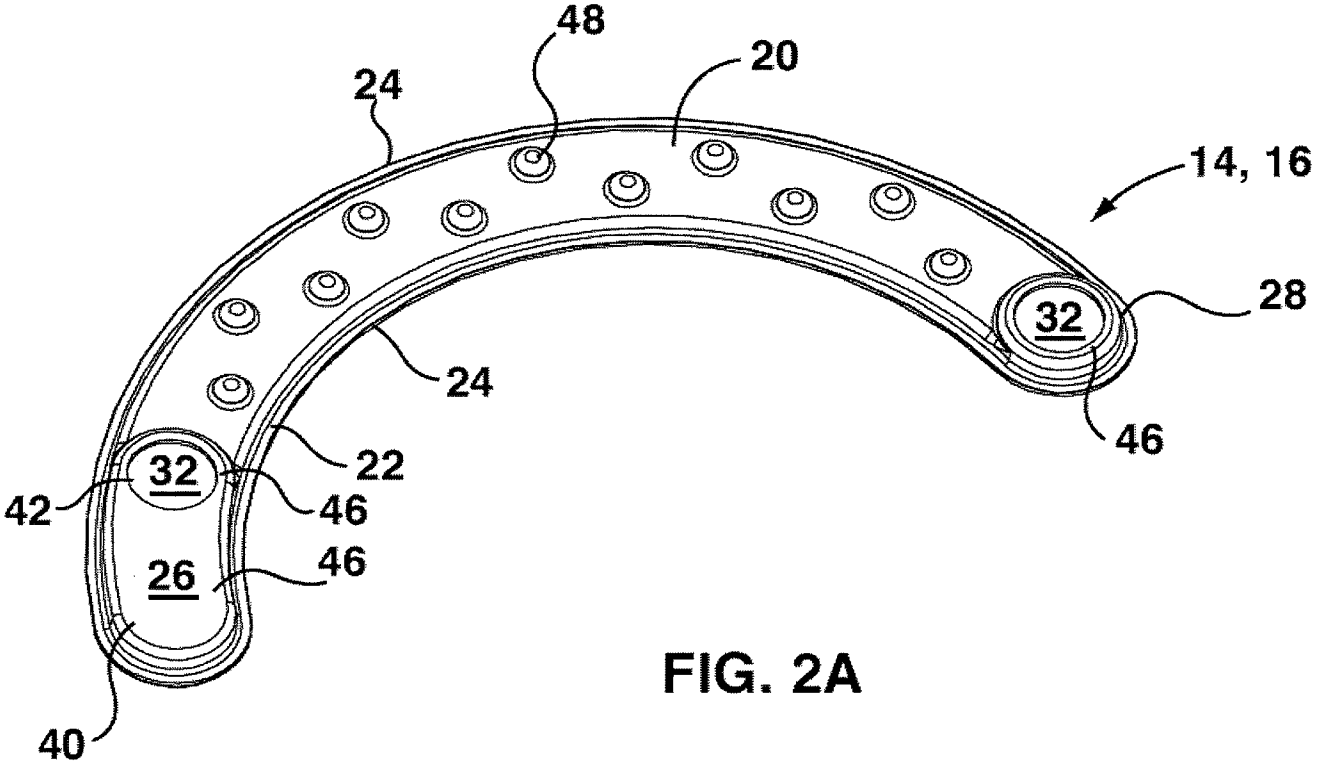
FIG. 2A is a top perspective view of a heat exchanger plate of the heat exchanger shown in FIG. 1 showing a second arrangement of inlet/outlet openings formed in the plate.
Figure 2B:
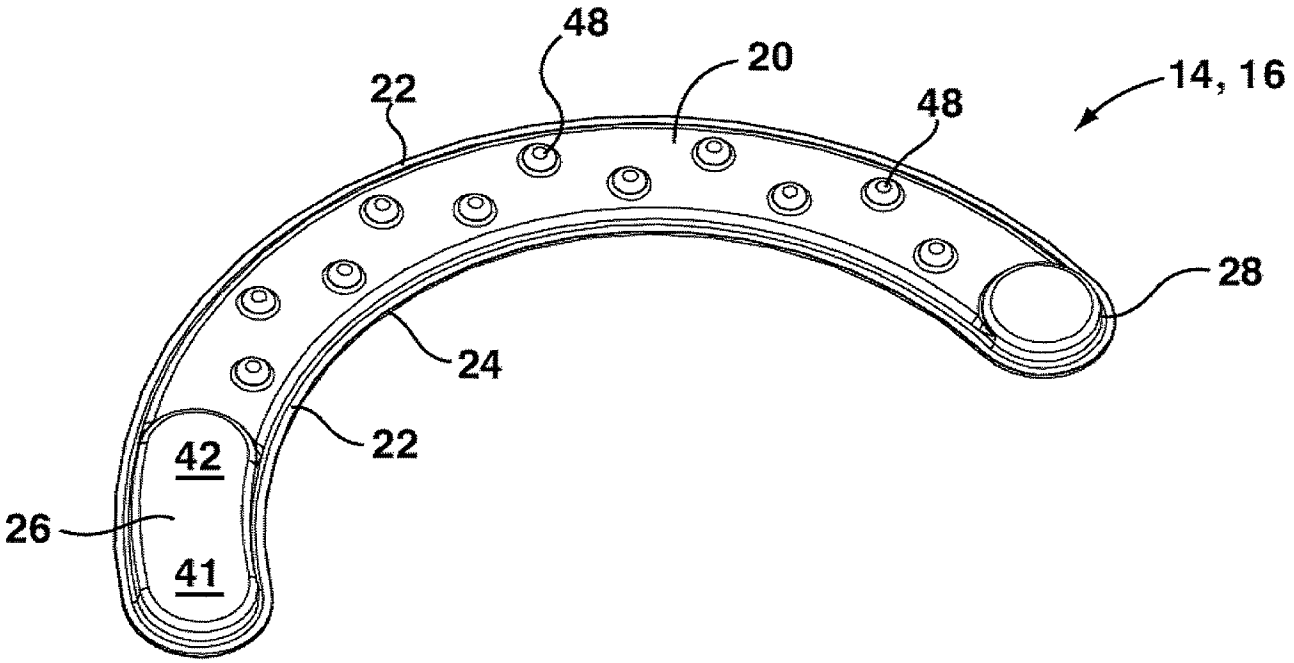
FIG. 2B is a top perspective view of a bottom or end plate of the heat exchanger shown in FIG. 1.
Figure 3:
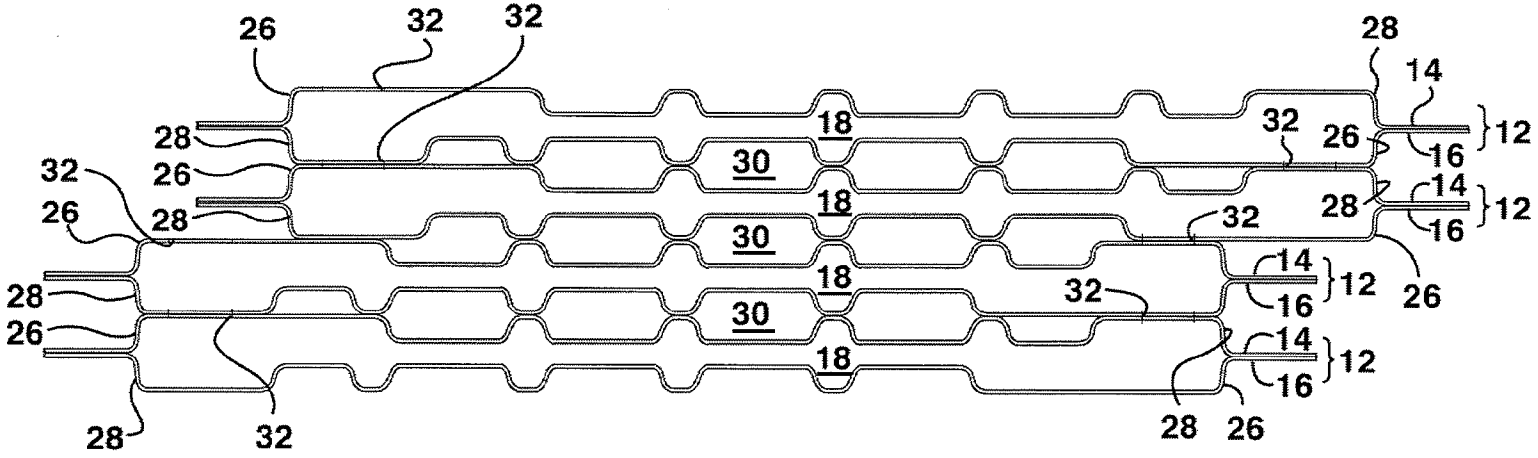
FIG. 3 is a representative sectional, elevation view of the heat exchanger of FIG. 1 taken through the centerline of the heat exchanger.

The elongated boss portion 26 of each of the first and second plates 14, 16 comprises a first position 40 and a second position 42 for the location of an inlet or outlet opening 32. The first and second positions 40, 42 are arranged adjacent to each other along the length of the heat exchanger plate 14, 16 with the first and second positions 40, 42 for the location of inlet/outlet opening 32 being located in the same plane. When the inlet/outlet 32 opening is formed in the first position 40 of the elongated boss portion 26, the second position 42 remains sealed or closed, as shown in FIG. 2. Similarly, when the inlet/outlet opening 32 is formed in the second position 42 of the elongated boss portion 26, the first position 40 remains sealed or closed. Accordingly, the elongated boss portion 26 of any of the first and second plates 14, 16 is provided with only one inlet/outlet opening 32, whether it is in the first position 40 or the second position 42, when in use. A heat exchanger plate 14, 16 with an inlet/outlet opening 32 formed in the first position 40 of the elongated boss portion 26 is shown in FIG. 2 and a heat exchanger plate 14, 16 with an inlet/outlet opening 32 formed in the second position 40 of the elongated boss portion 26 is shown in FIG. 2A. A heat exchanger plate 14, 16 prior to any inlet/outlet openings being formed therein is shown in FIG. 2B. A heat exchanger plate 14, 16 in this form can serve as the bottom or end plate of the heat exchanger 10 where both the inlet and outlet 38, 39 are located on the top of the heat exchanger 10 and the bottom or end plate remains closed.

Inlet and outlet openings 32 are formed in the respective boss portions 26, 28 such that a peripheral mating surface 46 surrounds each inlet/outlet opening 32. When the plate pairs 12 are stacked together to form the heat exchanger 10, the peripheral mating surfaces 46 of one plate 14, 16 of one plate pair 12 aligns with and mates with the corresponding peripheral mating surfaces 46 of the adjacent plate 14, 16 of the adjacent plate pair 12 which surfaces 46 are sealably joined together to form inlet/outlet manifolds 34, 36.

Figure 4:
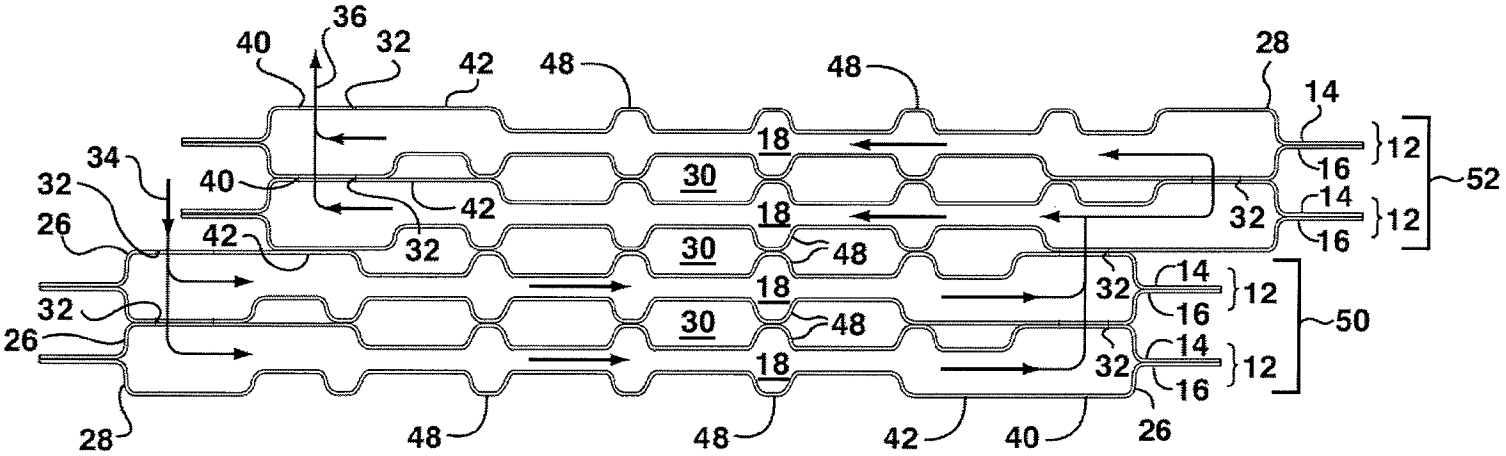
FIG. 4 is a schematic fluid flow diagram of the heat exchanger shown in FIG. 3.

The embodiment shown in FIGS. 1 and 4, heat exchanger 10 is in the form of a two-pass heat exchanger with the inlet and outlet manifolds 34, 36 being located at the same end of the heat exchanger 10. In order to achieve this particular arrangement, the heat exchanger 10 is comprised of a first stack 50 of plate pairs 12 and a second stack 52 of plate pairs 12 that are offset with respect to each other by a distance X along the length of the heat exchanger 10. Distance X (see FIG. 1) being equivalent to the distance between the centre points of the first and second positions 40, 42 in the elongated boss portion 26. A first fluid enters inlet manifold 34, through inlet fitting 38, and enters fluid passages 18 in each of the stacked plate pairs 12 in the first stack 50 through corresponding inlet openings 32 formed in the boss portions 26, 28 of the plates 14, 16. In the subject embodiment, the first plates 14 of each plate pair 12 are provided with fluid inlet opening 32 in the first position 40 (i.e. the outermost position) of the elongated boss portion 26. Once fluid enters the fluid passages 18 by means of the inlet manifold 34, the fluid flows through the first fluid passages 18 along the length of the plates 14, 16 and exits the first stack 50 of plate pairs 12 through outlet openings 32 located at the opposed ends of the plates 14, 16 which are also formed in the first or outermost position 40 of the elongated boss portion 26, where required. The fluid exiting the first stack 50 then enters the second stack 52 of plate pairs 12 through an inlet opening 32 formed in the second position 42 of the elongated boss portion 26 of the second plate 16 of the lowermost plate pair 12 in the second stack 52 of plate pairs 12. The fluid then enters the remaining plate pairs 12 in the second stack 52 through corresponding inlet openings 32 formed in boss portions 28 and the first position 40 of elongated boss portion 26 and travels through fluid passages 18 in a direction opposite to the fluid flow in the first stack 50 of plate pairs 12 to outlet manifold 36. The fluid exits the heat exchanger 10 through outlet fitting 39 once it has completed the two passes within the heat exchanger core.

FIG. 4 is a schematic flow diagram, of heat exchanger 10 illustrating the location of the various inlet/outlet openings 32 formed in the plates 14, 16 and the flow through the heat exchanger 10.

As a result of the flexibility provided by the elongated boss portion 26 in plates 14, 16 offering both a first position 40 and a second position 42 for the location of an inlet/outlet opening 32, heat exchanger 10 is a two-pass heat exchanger with inlet and outlet manifolds 34, 36 being positioned adjacent to each other at the same end of the heat exchanger 10 that is formed using stacked heat exchanger plates 14, 16 that are of the same structural design, the only difference between some of the plates being the location of the inlet/opening in the elongated boss portion 26. Accordingly, a variety of heat exchangers can be formed using the same single plate design.

While FIGS. 1 and 4 show the heat exchanger 10 as being a two-pass heat exchanger comprised of first and second stacks 50, 52 each with only two plate pairs 12, it will be understood that it is intended to be exemplary and it will be understood that the heat exchanger 10 can comprise as many plate pairs 12 and as many passes as required, depending upon a particular application and/or design.

Figure 6:
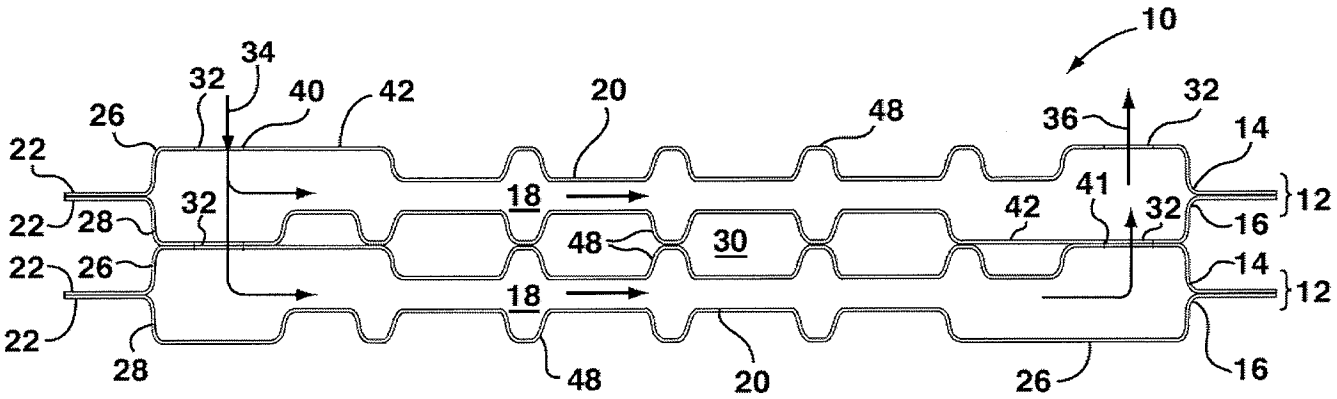
FIG. 6 is a sectional view of a heat exchanger comprised of a plurality of stacked plate pairs formed by the heat exchanger plate shown in FIG. 5.

Furthermore, it will be understood that the heat exchanger formed by plates 14, 16 does not necessarily need to be a two or multiple-pass heat exchanger and that a single-pass heat exchanger with inlet and outlet manifolds 34, 36 located at respective ends of the heat exchanger is also contemplated within the scope of the present disclosure, as shown for instance in FIG. 6. In this arrangement of plate pairs 12, only the first position 40 on the elongated boss portion 26 is used in all of the plates 14, 16 that form the heat exchanger.

As shown in the drawings, the central planar portion 20 of first and second plates 14, 16 can also be formed with spaced-apart outwardly projecting protrusions 48 arranged in a predetermined pattern. In the embodiments shown, the protrusions 48 are in the form of dimples; however, other shapes are contemplated within the scope of the present disclosure.

The protrusions 48 are arranged in a predetermined pattern that ensures that when the plate pairs 12 are stacked together to form the heat exchanger 10, the protrusions 48 on the first plate 14 of one plate pair 12 will abut with the protrusions 48 or with a portion of the upper surface of the elongated boss portion 26 on the corresponding second plate 16 of the adjacent plate pair 12. The protrusions 48 provide support to the central planar portions 20 of the first and second plates 14, 16 when arranged as plate pairs 12 and stacked together to form the heat exchanger 10. They also serve to increase heat transfer between the first and second fluids flowing through heat exchanger 10. Protrusions (not shown) can also be formed on the inside surface of the plates 14, 16 to provide support across the central, planar portions 20 and to increase heat transfer properties within the first fluid passageways 18.

Figure 7:
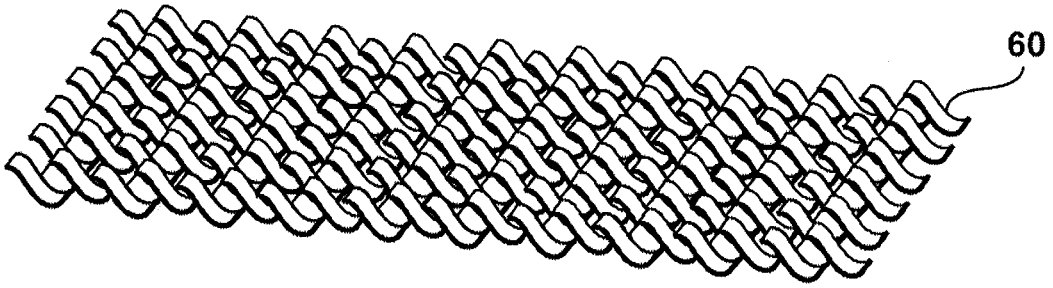
FIG. 7 is an exemplary embodiment of a portion of a turbulizer that can be used in the fluid passages formed by the plate pairs of the heat exchanger shown in FIG. 6.

Instead of having protrusions 48 formed on the outer (and/or) inner surfaces of the plates 14, 16, turbulizers and/or corrugated fins can be positioned within the first and/or second fluid passages 18, 30 as is known in the art. A portion of an exemplary turbulilzer 60 that can be used for augmenting heat transfer properties within fluid passages 18 is shown in FIG. 7.

For the purpose of this disclosure, terms such as "upper", "lower", "upward", "downward", "raised", "depressed", etc. and the like are used herein as terms of reference to describe features of the heat exchangers and the heat exchanger plates according to the invention disclosed in the subject application. It will be appreciated that these terms are used for convenience only and that the heat exchangers and heat exchanger plates described herein can have any desired orientation when in use.

Furthermore, it will be understood that certain adaptations and modifications of the described embodiments can be made as construed within the scope of the present disclosure. Therefore, the above discussed embodiments are considered to be illustrative and not restrictive.

We claim:

1. A heat exchanger comprising:

a plurality of stacked plate pairs, each plate pair including first and second plates having elongate, central planar portions surrounded by peripheral edge portions, the peripheral edge portions of the first and second plates being sealably joined together;

a first set of fluid passages defined between the elongate, central planar portions of said first and second plates;

first and second boss portions formed at respective ends of each of said first and second plates and spacing apart one plate pair from an adjacent plate pair in said plurality of stacked plate pairs, the first and second boss portions defining respective inlet and outlet openings, the respective inlet and outlet openings of each of said first and second plates communicating to define respective inlet and outlet manifolds;

one of said first and second boss portions being formed as an elongated boss portion thereby defining a first position and a second position for the location of a flow opening, said flow opening being one of said inlet and outlet openings in one of said inlet and outlet manifolds;

wherein the first and second positions in said elongated boss portion are adjacent to each other along the length of the first and second plates, and wherein only one of said first and second positions is provided with said flow opening.

2. The heat exchanger as claimed in claim 1, wherein the heat exchanger further comprises:

a first stack of plate pairs;

a second stack of plate pairs arranged on top of and in mating relationship with said first stack of plate pairs;

wherein said second stack of plate pairs is offset with respect to said first stack of plate pairs along the length of the heat exchanger.

3. The heat exchanger as claimed in claim 1, wherein said second plates are identical in structure to said first plates, the second plate being inverted with respect to said first plate to form said plurality of plate pairs.

4. The heat exchanger as claimed in claim 1, wherein said second plates are identical in structure to said first plates, the second plate being inverted and rotated 180 degrees with respect to said first plate in at least some of said plurality of plate pairs.

5. The heat exchanger as claimed in claim 1, wherein said heat exchanger is a two-pass heat exchanger.

6. The heat exchanger as claimed in claim 5, wherein said inlet and outlet manifolds are disposed adjacent to each other along the length of the heat exchanger.

7. The heat exchanger as claimed in claim 1, wherein said inlet and outlet manifolds are disposed at respective ends of said heat exchanger.

8. The heat exchanger as claimed in claim 1, wherein the elongate, central planar portions of the first and second plates are formed with a plurality of spaced-apart outwardly disposed protrusions.

9. The heat exchanger as claimed in claim 7, wherein the protrusions are formed and spaced-apart in a predetermined pattern.

10. The heat exchanger as claimed in claim 7, wherein the protrusions are in the form of one of the following alternatives: dimples, ribs or a combination thereof.

11. The heat exchanger as claimed in claim 1, further comprising turbulizers located in the first set of fluid passages.

12. The heat exchanger as claimed in claim 1, wherein said first and second plates are arcuate.

13. The heat exchanger as claimed in claim 1, further comprising a second set of fluid passages formed between said spaced-apart stacked plate pairs.

14. The heat exchanger as claimed in claim 13, further comprising heat transfer augmentation devices located in said second set of fluid passages.

* * * * *